US006358404B1

(12) United States Patent
Brown et al.

(10) Patent No.: US 6,358,404 B1
(45) **Date of Patent: *Mar. 19, 2002**

(54) METHOD FOR RECOVERY OF HYDROCARBON DILUENT FROM TAILING

(75) Inventors: Wayne Brown, Edmonton; Michelle Portwood; Fran King, both of Fort McMurray; Barry Bara; Michael Wagner, both of Edmonton, all of (CA)

(73) Assignee: AEC Oil Sands, L.P. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/316,006

(22) Filed: May 21, 1999

(30) Foreign Application Priority Data

May 13, 1999 (CA) ..... 2272045

(51) Int. Cl.[7] ..... C10G 1/04
(52) U.S. Cl. ..... 208/390; 208/391
(58) Field of Search ..... 208/390

(56) References Cited

U.S. PATENT DOCUMENTS

| | | | | | |
|---|---|---|---|---|---|
| 4,126,743 | A | * | 11/1978 | Shiomura | 528/503 |
| 4,613,484 | A | * | 9/1986 | Ayers et al. | 422/132 |
| 5,236,577 | A | * | 8/1993 | Tipman et al. | 208/390 |
| 5,985,138 | A | * | 11/1999 | Humprrys | 208/390 |

FOREIGN PATENT DOCUMENTS

| | | |
|---|---|---|
| CA | 1027501 | 3/1987 |
| CA | 1239888 | 8/1999 |

* cited by examiner

*Primary Examiner*—Helane E. Myers

(57) ABSTRACT

A method for recovery of hydrocarbon diluent from tailings produced in a bitumen froth treatment plant comprises introducing the tailings into a steam stripping vessel maintained at near atmospheric pressure, said vessel having a plurality of interior, vertically spaced shed decks, and distributing the tailings over said shed decks. Steam is introduced below the shed decks for vaporizing the major portion of the contained diluent and some water.

6 Claims, 2 Drawing Sheets

METHOD FOR RECOVERY OF HYDROCARBON DILUENT FROM TAILING

FIELD OF THE INVENTION

The present invention relates to a method for recovery of hydrocarbon diluent from a slurry such as tailings produced in a bitumen froth treatment plant. More particularly, hydrocarbon diluent is removed from the tailings in a stripping vessel using steam at atmospheric pressure.

BACKGROUND OF THE INVENTION

Oil sand, as known in the Fort McMurray region of Alberta, Canada, comprises water-wet sand grains having viscous bitumen flecks trapped between the grains. The oil sand lends itself to separating or dispersing the bitumen from the sand grains by slurrying the as-mined oil sand in water so that the bitumen flecks move into the aqueous phase.

For the past 25 years, the bitumen in McMurray oil sand has been commercially recovered using a hot water process. In general, the process involves slurrying oil sand with heated water, steam, usually some caustic and naturally entrained air. The slurry is mixed, commonly in tumblers, for a prescribed retention time to initiate a preliminary separation or dispersal of the bitumen and the solids and to induce air bubbles to contact and aerate the bitumen. The conditioned slurry is then subjected to flotation to further separate the bitumen from the sand.

A recent development in the recovery of bitumen from oil sand involves a low temperature process whereby the oil sand in mixed with heated water directly at the mine site to produce a pumpable, dense, low temperature slurry. The slurry is then pumped through a pipeline to condition the slurry for flotation.

The conditioned slurry obtained by either process described above is further diluted with heated water and introduced into a large, open-topped, conical-bottomed, cylindrical vessel (termed a primary separation vessel or "PSV"). The diluted slurry is retained in the PSV under quiescent conditions for a prescribed retention period. During this period, the aerated bitumen rises and forms a froth layer, which overflows the top lip of the vessel and is conveyed away in a launder. The sand grains sink and are concentrated in the conical bottom. They leave the bottom of the vessel as a wet tailings stream. Middlings, a watery mixture containing solids and bitumen, extend between the froth and sand layers.

The wet tailings and middlings are withdrawn, combined and sent to a secondary flotation process. This secondary flotation process is commonly carried out in a deep cone vessel wherein air is sparged into the vessel to assist with flotation. This vessel is referred to as the TOR vessel. It and the process conducted in it are disclosed in U.S. Pat. No. 4,545,892, incorporated herein by reference. The bitumen recovered by the TOR vessel is recycled to the PSV. The middlings from the deep cone vessel are further processed in air flotation cells to recover contained bitumen.

The froths produced by these units are combined and subjected to further processing. More particularly, it is conventional to dilute the bitumen froth with a light hydrocarbon diluent, such as a paraffinic diluent or naphtha, to first improve the difference in specific gravity between the bitumen and water and to reduce the bitumen viscosity, to aid in the separation of the water and solids from the bitumen. Separation of the bitumen from water and solids is commonly achieved by treating the froth in a sequence of scroll and disc centrifuges. However, there has been a recent trend towards using an inclined plate settling process for separating bitumen from the water and solids.

The primarily water and solids fraction obtained after separation is commonly referred to as froth treatment tailings consist of a slurry. These froth treatment tailings typically comprising approximately 2.0 wt. % hydrocarbon diluent, 4.5 wt. % bitumen, 17 wt. % particulate solids and 76.5 wt. % water. It is desirable both economically and environmentally to recover the hydrocarbon diluent from the tailings prior to disposal.

The unique nature of the diluent-containing tailings make diluent removal a challenge to the industry.

Canadian Patent No. 1,027,501 teaches a process for treatment of centrifuge tailings to recover naphtha. The process comprises introducing the tailings into a vacuum flash vessel maintained at about 35 kPa in order to flash the naphtha present in the tailings. The vessel is also equipped with a plurality of shed decks so that any residual naphtha remaining in the tailings stream will be vaporized by the introduction of steam beneath these shed decks.

In practice, how ever, this process results in only 60 to 65% recovery of the diluent, hence, a large amount of diluent is still being released to the environment.

SUMMARY OF THE INVENTION

In accordance with the present invention, heated (approximately 80° C.) froth treatment tailings are initially housed in a feed box where additional water may be added if necessary. As previously stated, the tailings are a slurry comprising bitumen, diluent, particulate solids and water. The tailings are introduced into the chambers of a steam stripping vessel which is maintained at near atmospheric pressure (approximately 95 kPa). Inside the steam stripping vessel there is a stack of vertically and laterally spaced apart shed decks and directly below these shed decks is a source of steam. When the liquid tailings stream is fed into the vessel, it is evenly distributed over these shed decks to maximize the surface area of the liquid feed. Steam is injected into the chamber between the pool of stripped tailings at the base of the chamber and the shed decks. The steam is passed countercurrently to the tailings to provide heat for vaporizing hydrocarbon diluent and a small portion of the water contained in the tailings. Preferably, sufficient steam is supplied to maintain the steam to slurry ratio between 2.4 and 10.8 wt. %. The produced vapors and residual tailings are separately removed from the vessel chamber. The produced vapor steam is cooled to its liquid components in a condenser.

In summary, the present invention is a method for recovering light hydrocarbon diluent from a tailings slurry, produced in the treatment of bitumen froth, comprising bitumen, particulate solids, diluent and water comprising:

introducing the slurry into a steam stripping vessel chamber maintained at near atmospheric pressure, said vessel chamber having a stack of internal, vertically and laterally spaced shed decks, and distributing the slurry over the shed decks so that the slurry flows downwardly through the stack;

introducing steam into the chamber below the shed decks so that it flows countercurrently to the slurry and heats the slurry to vaporize diluent and water and produce vapors thereof; and separately removing the vapors and residual slurry from the chamber.

In a preferred embodiment, the vessel temperature is maintained at approximately 100° C. and the steam to tailings ratio is maintained at about 2.4 to 10.8 wt. %, more 9 wt. %.

In another preferred embodiment, the hydrocarbon diluent being recovered is naphtha or paraffinic diluent.

In another preferred embodiment, the hydrocarbon diluent and water are separated in a decanter. The diluent can then be reused and the water can be recycled back to the feed box.

The invention is based on the discovery that the prior art system of maintaining a vacuum condition at the inlet to the vessel resulted in flashing which caused turbulence causing the feed tailings at least partly to move down the vessel chamber along its inner surface, thereby bypassing the shed decks. In other words, the vessel was operating primarily as a flash vessel and the addition of steam at the bottom of the shed decks was failing to carry out stripping of diluent. As a result, only 60 to 65% of the naphtha was being recovered primarily as a result of flashing.

By operating the vessel at near atmospheric pressure and at a steam to tailings ratio of approximately 9.0 wt. %, naphtha recovery increased to about 80%. It is believed that the increase in naphtha recovery is as a result of the tailings now being evenly distributed on the shed decks, thereby allowing for steam stripping of the diluent contained in the tailings.

DESCRIPTION OF THE PREFERRED EMBODIMENT

Figure 1:
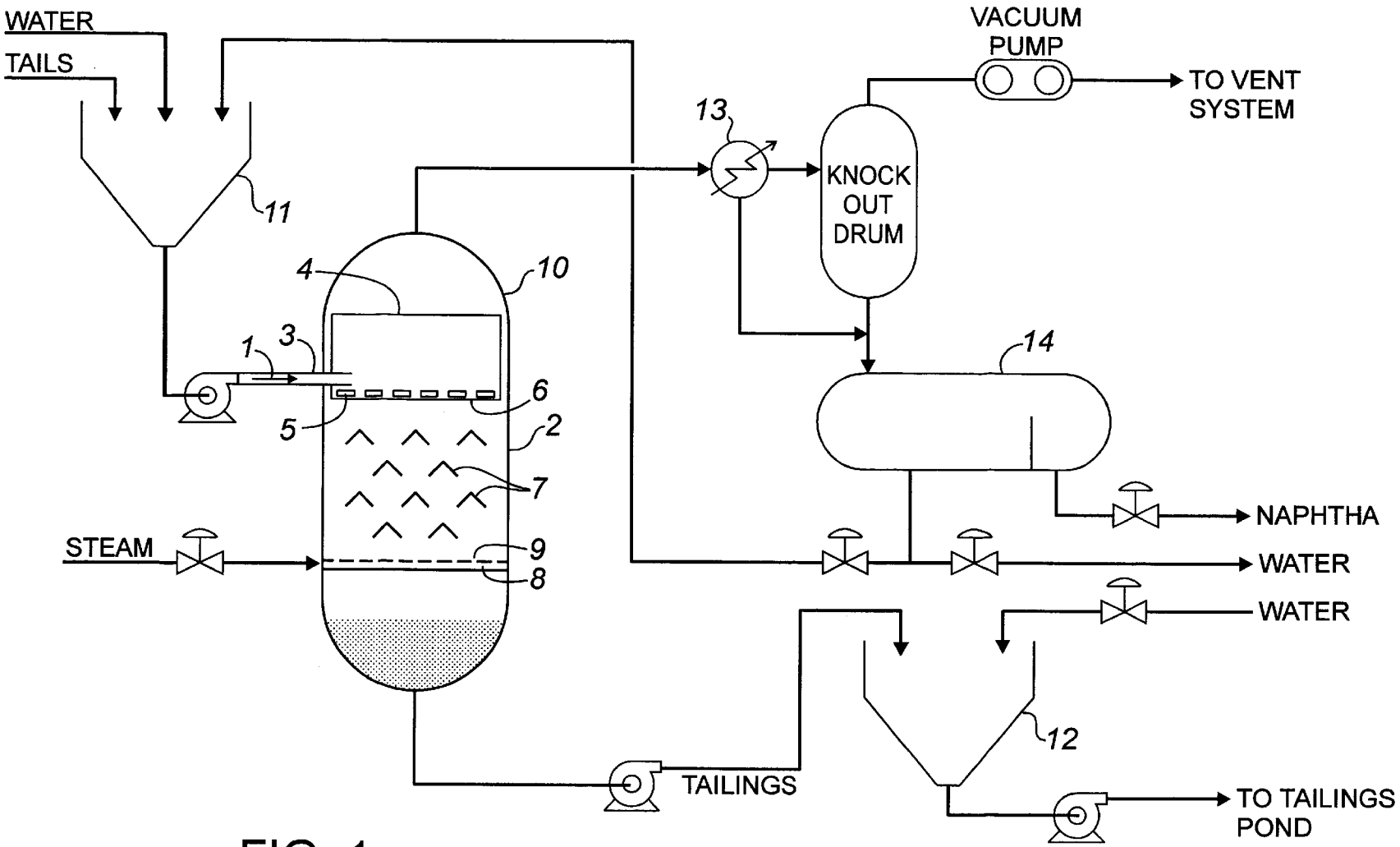
FIG. 1 is a schematic showing the hydrocarbon diluent extraction circuit.

The present method for hydrocarbon diluent recovery from froth treatment tailings can be best described with reference to FIG. 1. A stream of heated froth treatment tailings 1 is initially housed in a feed box 11 where additional water may or may not be added. The heated tailings are then fed into the steam stripping vessel 2 via an inlet pipe 3. The inlet pipe 3 is connected to a feed box distributor 4, said distributor 4 having a plurality of openings 5 near its bottom end 6. Directly below the distributor 4 is a series of shed decks 7. The distributor 4 functions to evenly distribute the feed (i.e. tailings) over the series of shed decks 7. The shed decks 7 ensure that the tailings are spread over a large surface area that can subsequently be exposed to steam.

Optimum distribution of the feed onto the shed decks 7 occurs when the feed that is introduced into the distributor 4 is below its bubble point, hence, in a liquid state. The feed is maintained in its liquid state when the steam stripping vessel 2 is operated at or near atmospheric pressure. If the pressure of the vessel is below atmospheric pressure, the feed will be in a biphasic state (i.e. both liquid and vapour) and will not be properly distributed by the distributor 4 over the shed decks 7. This is because, under vacuum conditions, the feed is propelled to the sides of the distributor 4 so that much of the feed bypasses the shed decks 7.

Directly below the shed decks 7 is a steam ring 8 having a plurality of openings 9 for the release of steam. The steam countercurrently contacts the tailings distributed over the shed decks 7 and provides the necessary heat for vaporizing the hydrocarbon diluent and a portion of the contained water. The diluent-stripped feed settles to the bottom of the vessel 10 and the "clean" tailings are then removed to a tailings box 12. Additional water may be added to the tailings box 12 before the tailings are disposed into tailings ponds.

The vaporized diluent and water stream is then passed through a condenser-cooler 13 where it is cooled. The liquid product is collected in a decanter 14 where the water settles to the bottom and the diluent floats to the top. The diluent can be reused and the water can be recycled back to the feed box.

EXAMPLE 1

Naphtha recovery conducted in accordance with the present invention was tested as follows. The diluent-containing tailings used in this example consisted of 78 wt. % water, 15.5 wt. % solids, 2.0 wt. % naphtha and 4.5 wt. % bitumen. The pressure in the steam stripping vessel was fixed at 95 kPa and the temperature was maintained at about 100° C. The steam to tailings ratio was varied from about 5.5 wt. % to about 8.5 wt. % and naphtha flow rate (measured in l/sec) determined.

Figure 2:
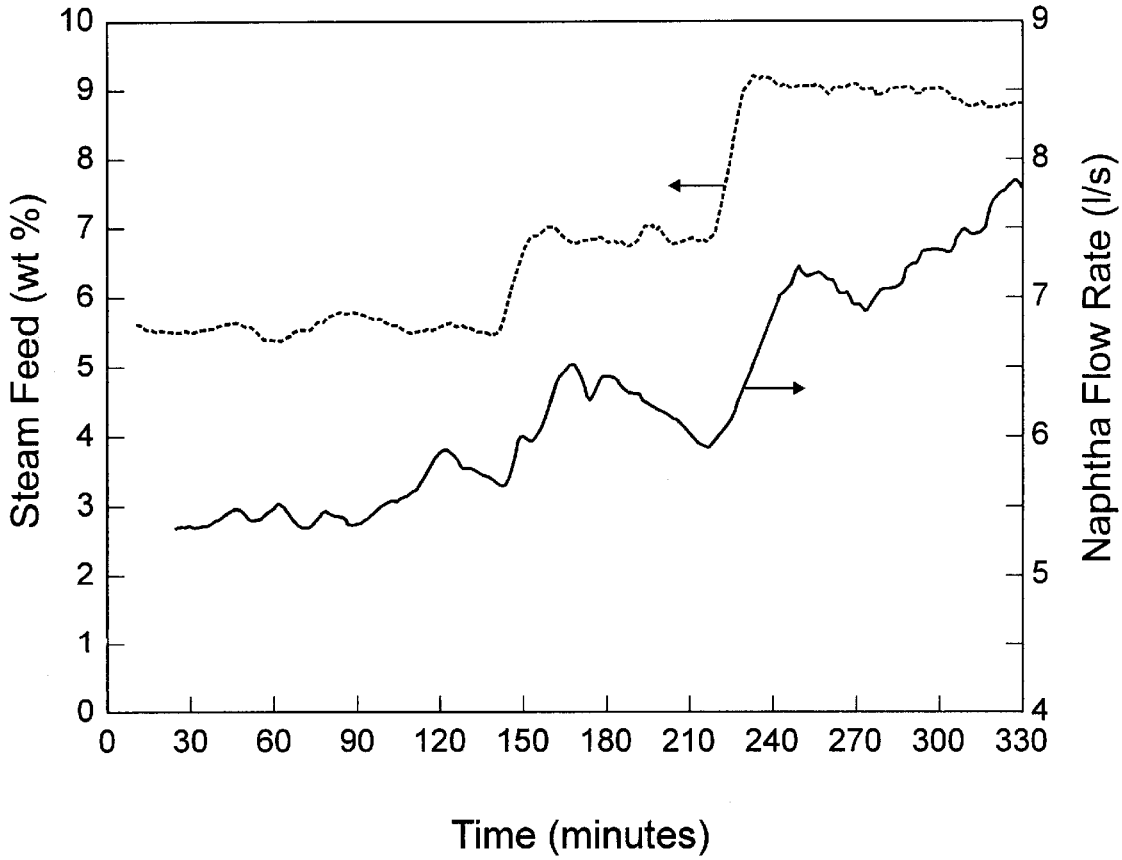
FIG. 2 is a plot of steam to tailings ratio versus time showing the effect on naphtha recovery relative to increasing steam to tailings ratio.

FIG. 2 shows that the higher the steam to tailings ratio, the greater the amount of naphtha released.

The embodiments of the invention in which an exclusive property or privilege is claimed are defined as follows:

1. A method for recovering light hydrocarbon diluent from a tailings slurry, produced in the treatment of bitumen froth, comprising bitumen, particulate solids, diluent and water, comprising:

introducing the slurry into a steam stripping vessel chamber maintained at near atmospheric pressure, said vessel chamber having a stack of internal, vertically and laterally spaced shed decks, and distributing the slurry over the shed decks so that the slurry flows downwardly through the stack;

introducing steam into the chamber below the shed decks so that it flows countercurrently to the slurry and heats the slurry to vaporize diluent and water and produce vapors thereof; and separately removing the vapors and residual slurry from the chamber.

2. The method as set forth in claim 1 wherein:

the steam to slurry ratio is between 2.4 and 10.8 wt. %.

3. The method as set forth in claim 2 wherein:

the diluent is selected from the group consisting of naphtha and parafinnic diluents.

4. The method as set forth in claim 3 wherein:

the steam to tailings ratio is about 9 wt. %.

5. The method as set forth in claim 3 wherein the pressure in the chamber is maintained at about 95 kPa.

6. The method as set forth in claim 4 wherein the pressure in the chamber is maintained at about 95 kPa.

* * * * *